US009192806B2

(12) United States Patent
Mial

(10) Patent No.: US 9,192,806 B2
(45) Date of Patent: Nov. 24, 2015

(54) EXERCISE ASSEMBLY

(71) Applicant: Scott M. Mial, Lamoni, IA (US)

(72) Inventor: Scott M. Mial, Lamoni, IA (US)

( * ) Notice: Subject to any disclaimer, the term of this patent is extended or adjusted under 35 U.S.C. 154(b) by 214 days.

(21) Appl. No.: 13/686,148

(22) Filed: Nov. 27, 2012

(65) Prior Publication Data

US 2013/0150218 A1 Jun. 13, 2013

Related U.S. Application Data

(60) Provisional application No. 61/568,454, filed on Dec. 8, 2011.

(51) Int. Cl.

| | |
|---|---|
| ***A63B 21/02*** | (2006.01) |
| ***A63B 21/00*** | (2006.01) |
| ***A63B 21/04*** | (2006.01) |
| ***A63B 21/055*** | (2006.01) |
| ***A63B 23/04*** | (2006.01) |

(52) U.S. Cl.

CPC ..... *A63B 21/1419* (2013.01); *A63B 21/00065* (2013.01); *A63B 21/00069* (2013.01); *A63B 21/0407* (2013.01); *A63B 21/0552* (2013.01); *A63B 21/0557* (2013.01); *A63B 21/1423* (2013.01); *A63B 21/1449* (2013.01); *A63B 23/0482* (2013.01)

(58) Field of Classification Search

CPC ..... A63B 21/0552; A63B 21/0557; A63B 21/00065; A63B 21/1449; A63B 21/00; A63B 21/00138; A63B 21/02; A63B 21/04; A63B 21/0442; A63B 21/054; A63B 21/05; A63B 21/055; A63B 21/0555; A63B 21/1403; A63B 21/1419; A63B 21/1423; A63B 21/1476

USPC ..... 482/121–122, 124

See application file for complete search history.

(56) References Cited

U.S. PATENT DOCUMENTS

| | | | | |
|---|---|---|---|---|
| 2,629,094 | A * | 2/1953 | Goldsmith | 2/465 |
| 5,357,637 | A * | 10/1994 | Moore | 2/227 |
| 5,465,428 | A * | 11/1995 | Earl | 2/238 |
| 5,490,826 | A * | 2/1996 | Rose | 482/74 |
| 6,231,488 | B1 * | 5/2001 | Dicker et al. | 482/124 |
| 7,758,481 | B2 * | 7/2010 | Drennan | 482/124 |
| 8,707,463 | B2 * | 4/2014 | Orloff | 2/22 |
| 2003/0092545 | A1 * | 5/2003 | Koscielny et al. | 482/124 |
| 2004/0116260 | A1 * | 6/2004 | Drennan | 482/124 |
| 2005/0251895 | A1 * | 11/2005 | Farrah et al. | 2/227 |
| 2005/0252717 | A1 * | 11/2005 | Farrah et al. | 182/3 |
| 2005/0261113 | A1 * | 11/2005 | Wilkinson | 482/124 |
| 2006/0199706 | A1 * | 9/2006 | Wehrell | 482/92 |
| 2007/0027419 | A1 * | 2/2007 | Drennan | 602/19 |
| 2007/0135278 | A1 * | 6/2007 | Grigoriev et al. | 482/124 |
| 2007/0135279 | A1 * | 6/2007 | Purdy et al. | 482/124 |
| 2007/0287616 | A1 * | 12/2007 | Weaver | 482/124 |
| 2008/0300118 | A1 * | 12/2008 | Wehrell | 482/129 |

(Continued)

*Primary Examiner* — Oren Ginsberg
*Assistant Examiner* — Andrew S Lo
(74) *Attorney, Agent, or Firm* — Zarley Law Firm, P.L.C.

(57) ABSTRACT

An exercise system is presented utilizing a plurality of adjustable resistance members. Specifically, an athletic garment is presented, such as athletic shorts, having a plurality of padded elements therein which cover a user's muscles and provide resistance when exercising. In addition, the garment has a plurality of opposing attachment sites and a plurality of resistance bands connected between opposing attachment sites. When a user wears the athletic garment while exercising, the padded elements and the resistance bands stretch and resist movement thereby providing an improved workout.

10 Claims, 2 Drawing Sheets

(56) References Cited

U.S. PATENT DOCUMENTS

| | | | | |
|---|---|---|---|---|
| 2009/0062087 | A1* | 3/2009 | Poppinga | 482/124 |
| 2009/0258768 | A1* | 10/2009 | Clarke | 482/124 |
| 2010/0077527 | A1* | 4/2010 | Lee et al. | 2/69 |
| 2010/0088803 | A1* | 4/2010 | Orloff | 2/228 |
| 2010/0160059 | A1* | 6/2010 | Burgess | 473/207 |
| 2010/0222189 | A1* | 9/2010 | Washington | 482/124 |
| 2011/0207585 | A1* | 8/2011 | Burns | 482/124 |
| 2012/0202658 | A1* | 8/2012 | Menefee, Sr. | 482/124 |
| 2012/0270708 | A1* | 10/2012 | Paulos | 482/124 |
| 2012/0283077 | A1* | 11/2012 | Cranke | 482/124 |
| 2012/0322635 | A1* | 12/2012 | Carter | 482/129 |

* cited by examiner

EXERCISE ASSEMBLY

CROSS REFERENCE TO RELATED APPLICATION

This application claims the benefit of U.S. Provisional Application No. 61/568,454 filed Dec. 8, 2011.

BACKGROUND OF THE INVENTION

This invention is related to exercising. More specifically this invention is related to an exercising system that utilizes resistance to enhance exercising.

Exercising and working out is a common practice among individuals to keep themselves in shape. Specifically, individuals can either go to a track, gym or in the comfort of their own home to lift weights, use exercise bikes, treadmills, go running, walking, or do hurdles, engage in sports such as karate and the like in order to provide conditioning for themselves to get physically fit. Further, individuals rehabbing injuries similarly engage in conditioning to strengthen a muscle area that has been previously damaged.

Over the years many different training regiments have been developed and equipment invented in order to enhance the exercise experience. For example, weights are presented that vibrate in order to provide a different way of working muscle. Treadmills are built in with heart and pulse monitors in order to provide information about the individual while running. Other improvements have been presented in the clothing worn by athletes. For example, individuals in track and swimming wear skin-tight garments in order to make themselves more aerodynamic and faster.

Despite these improvement problems still remain. Specifically, lugging around heavy weights or being tied to a specific machine is often difficult and undesirable. Further, the cost of purchasing such equipment is often extremely expensive and thus not desired.

Thus a primary object of the present invention is to provide an exercise system that does not require heavy weights.

Another object of the present invention is to provide an exercise system that is efficient.

Yet another object of the present invention is to provide an exercise system that does not require the user to be tied to a particular machine.

Another object of the present invention is to provide an exercise system that is of minimal cost.

Yet another object of the present invention is to provide an exercise system that convenient to use.

These and other objects, features, or advantages of the present invention will become apparent from the specification and claims.

BRIEF SUMMARY OF THE INVENTION

An exercise system is presented utilizing a plurality of adjustable resistance members. Specifically, an athletic garment is presented, such as athletic shorts, having a plurality of padded elements therein which cover a user's muscles and provide resistance when exercising. In addition, the garment has a plurality of opposing attachment sites and a plurality of resistance bands connected between opposing attachment sites. When a user wears the athletic garment while exercising, the padded elements and the resistance bands stretch and resist movement thereby providing an improved workout.

DETAILED DESCRIPTION OF THE PREFERRED EMBODIMENT

Figure 1:
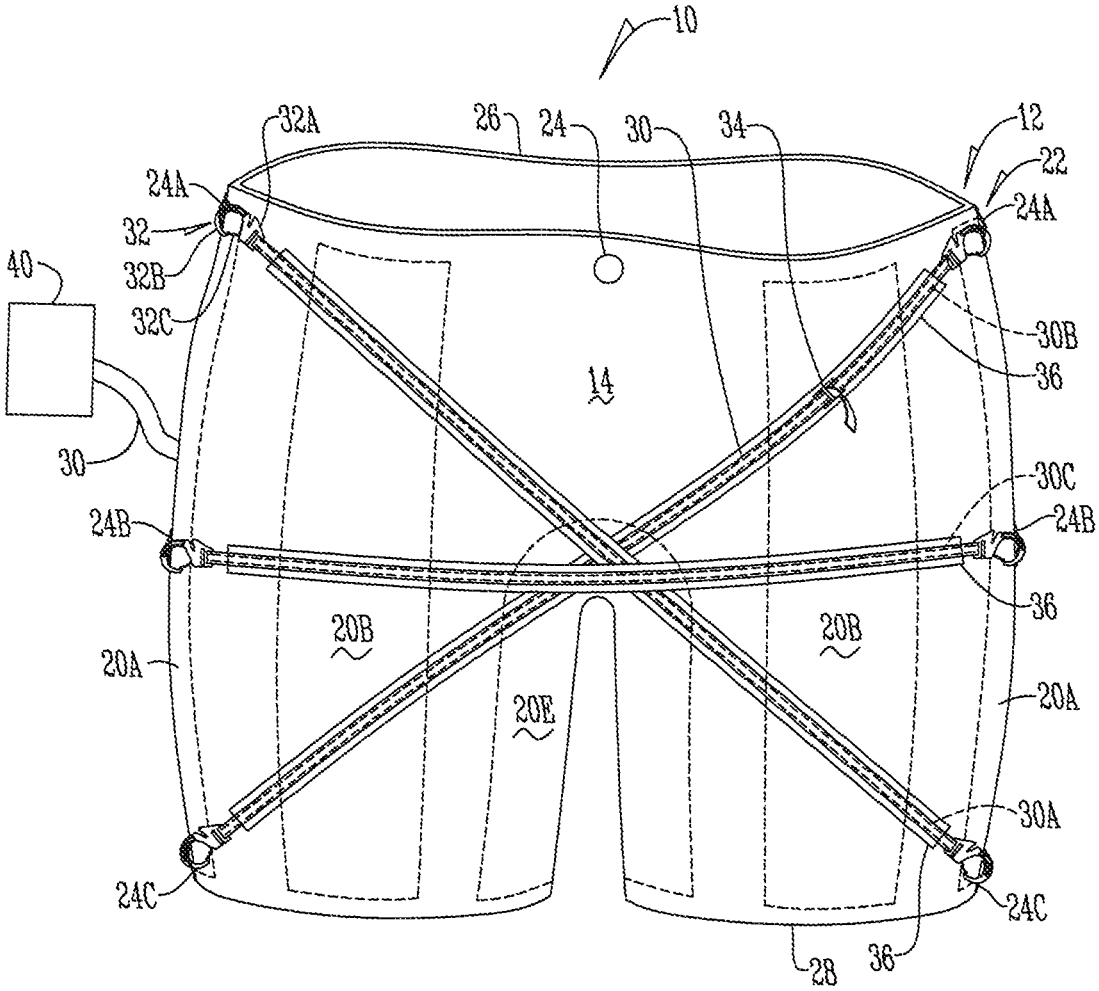
FIG. 1 is a front elevation view of an exercise system having resistance bands connected to loop attachment members by hooks.

The figures show an exercise system 10 that is utilized on a garment 12. As seen in the figures as an example embodiment, the garment 12 is a pair of athletic shorts; however, the system can be used on a shirt, sweatpants, full body suit, or any other garment or the like without falling outside the scope of this disclosure. With reference to the shorts as the garment 12, the garment 12 has an exterior surface 14 and an interior surface 16 with openings 18 therein that accommodate an individual's body parts as is known in the art.

The interior 18 of the garment 12, have padded elements 20. Padded elements 20, in one arrangement, are several millimeters thick thus are considered thickly padded in order to cover a majority of the anterior, lateral and posterior portion of the shorts 12. Specifically, the padded elements 20 have a thickness greater than a typical garment (e.g. thicker than a single layer of material from which garment 12 is made). In this manner, padded elements 20 engage and provide resistance to the limbs of an individual to resist movement during exercises and activities. In one arrangement, padded elements 20 are formed of a plurality of layers of material from which garment 12 is made. In another arrangement, padded elements are formed of a foam material, an elastic material, a cloth material, a spandex material, a nylon material, a neoprene material, a gel material, or any other material that is suitable for the application. That is, any material that is durable and provides a level of compression as well as a level of stretch.

A plurality of padded elements 20 are hereby contemplated. Padded elements 20 include a side leg pad 20A, a front leg pad 20B, a back leg pad 20C, each of which extend from the top of garment 12, adjacent the belt line to the bottom of garment 12 adjacent the knee area, each of which are positioned on the side, front and back of the user's leg, respectively. Additionally, a buttocks padd element 20D is positioned adjacent and across the user's buttocks. Additionally, a groin padd element 20E is positioned adjacent and across a user's groin. Other padded elements 2*o* are hereby contemplated which extend across any portion of garment 12.

A plurality of attachment sites 22 are disposed about the exterior 14 of the garment 12 in specific locations. The attachment sites 22 are detachably secured to the garment 12 or fixed onto the garment by any means known in the art such as stitching, gluing, welding or the like. In one arrangement, attachment sites 22 are zippers, buttons, portions of Velcro, coupling members, snap-fit members, loops, rings, D-rings, or the like. As one example, attachment sites 22 are a piece of material sewn to garment 12 to form a loop, similar to a belt loop. As another example, attachment sites 22 include a D-Ring attached to garment 12 by way of a piece of material which passes through the opening of the D-Ring and is sewn to garment 12. As another example, attachment sites 22 are posts 22A which extend outwardly from a base 22B which is attached by any of the means described above to either the interior 16 or exterior 14 of garment 12. In this arrangement, a head 22C is positioned on the end of post 22A. Head 22C is larger than post 22A and thereby prevents the opening 30-1 of resistance band 30 from sliding off post 22A during exercise.

As an example, when used on a pair of shorts 12 a series of three loops 24 are used on either side of the pair of shorts with the first loop 24A positioned approximately adjacent the top 26 of the shorts 12 adjacent an individual's hip; the second loop 24B positioned approximately at the middle of the shorts 12 adjacent an individual's buttocks or groin, and the third loop 24C is positioned approximately at the bottom 28 of the shorts 12 adjacent an individual's thigh and/or above the knee. The series of three loops 24A, 24B, 24C are presented in association with an individual's left leg and right leg and are symmetrically disposed about the individual. Also, a center front loop 24D and a center back loop 24E is presented.

While the figures only show a limited number of loops 24, additional loops are also hereby contemplated that extend below the knee, and/or above the belt line of the shorts, such as in the use of full length pants, a shirt or jacket, or in association with a full body suit.

A plurality of resistance bands 30 are connected to, connected between or disposed through the attachment sites 22. In one embodiment the resistance bands 30 are neoprene bands, bungee cords, elastic bands, rubber bands or stretchable members of any kind. In another embodiment, resistance bands include closed loop elastic bands such as a Thera-Bband® made of a rubber, latex, neoprene or elastic material, or any other stretchable material or band.

In one arrangement, a coupling device 32 is connected to each end of each resistance band 30. When attachment sites 22 are loops, rings or D-rings, coupling device 32 may include a hook having a connecting member 32A which connects to resistance band 30, a hook shaped member 32B and a locking member 32C. In this arrangement the connecting member 32A functions to connect coupling device 32 to resistance band 30 as well as allow the length of resistance band 30 to be adjusted, the hook member 32B connects to attachment site 22 and locking member 32C closes the opening of hook shaped member 32B once in place over attachment site 22, such as a loop or D-Ring, to ensure that the resistance band 30 is not unintentionally removed from attachment site 22 when in use. In another arrangement, when attachment sites 22 are posts 22A having heads 22C coupling device 32 is an opening 30-1 in resistance band 30 which is sized and shaped to fit over post 22A while being retained by head 22C. In this arrangement a plurality of openings 30-1 are positioned adjacent the end of resistance band 30 so that the proper length of resistance band 30 can be easily selected. This arrangement is not unlike the end of a conventional belt wherein there are a plurality of openings which can be selected to ensure the right length of the belt. In another arrangement, resistance band 30 is connected or sewn directly to attachment site 22, or directly to garment 12 without the use of an additional mechanism. Alternatively, resistance bands 30 are connected to attachment sites 22 by any other means known in the art for connecting two objects together.

Figure 2:
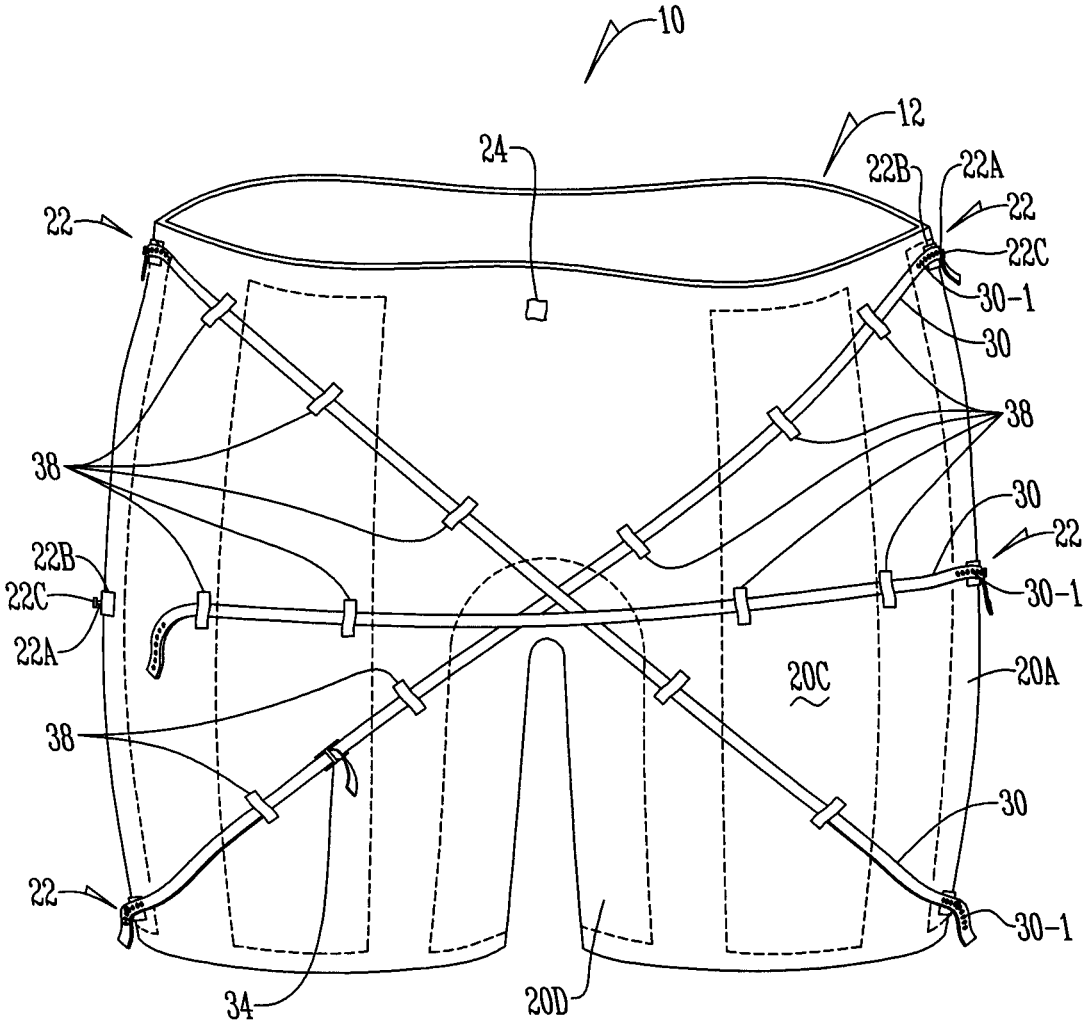
FIG. 2 is a back elevation view of an exercise system having resistance bands connected to attachment members which are posts by way of openings in the resistance bands.

As seen in the figures, a first resistance band 30A is connected to or placed through the attachment site 22 adjacent the thigh and above the knee on the left side of an individual and run to the attachment site 22 on the hip of the right side of the individual. A second resistance band 30B is connected to or placed through the attachment site 22 that goes from the thigh and knee attachment site 22 on the right side of the individual to the hip attachment site on the left side of the individual. Finally, a third resistance 30C band runs across an individual's body connecting the middle attachment sites 22. As is shown, this arrangement is symmetrical from side to side as well as being repeated for both the front (FIG. 1) and back (FIG. 2) of the user. While these are the connections shown, any number of resistance bands 30 can be placed in different arrangements without falling outside the scope of the present disclosure. That is, a band 30 can extend between opposing attachment sites 22 adjacent the user's knees, or between any of the attachment sites 22 shown on garment 12, or between any two portions of garment 12.

The resistance bands 30 themselves are elastic and flat and are color coded to have varying degrees of resistance with each different color representing a different strength of band depending on the need of the individual. Again, while in one arrangement the garment 12 is a pair of shorts, these resistance bands 30 are also utilized on a shirt, jogging pants, full body suit, shoes, leggings, sleeves, gloves, a jacket or the like to provide resistance to any portion of an individual's body during exercising.

Resistance bands 30 are of varying length such that the proper length of band 30 can be selected by the user without having to adjust the length of the band 30. In the event a band 30 is too long an adjustment mechanism 34 is connected to the resistance band 30. Adjustment mechanism 34 is connected to an end of band 30 or positioned between the ends of resistance band 30. Adjustment mechanism 34 is any device which adjusts the length and therefore the resistance of resistance band 30. Adjustment mechanisms 34 include an adjustable buckle, an adjustable loop, or any other mechanism which adjusts the length of resistance band 30. As is described above, adjustment mechanism 34 can be incorporated into coupling device 32.

The system also includes a plurality of sleeves 36. Sleeves 36 are hollow and sized to allow at least one elastic band 30 to extend there through. In one arrangement a sleeve 36 extends between each set of attachment sites 22 connected to a resistance band 30. Sleeves 36 are connected to garment 12 by any means known in the art such as gluing, stitching, welding or the like. In one arrangement, sleeves 36 are connected to garment 12 adjacent only the attachment site 22, along the entire length of sleeve 36, or intermittently along the length of sleeve 36. Also, where sleeves 36 overlap one another, such as in the groin or buttocks area shown in the figures, overlapping sleeves 36 are connected to one another while still allowing resistance bands 30 to pass therethrough. Alternatively, overlapping sleeves 36 are free and not connected to one another.

Sleeves 36 are formed out of any suitable material. In one arrangement sleeves 36 are formed of the identical material garment 12 is formed of, such as neoprene, spandex, or the like as is described above or known in the art. Sleeves 36 allow the resistance bands 36 to slide thereover and therethrough without excessive binding, resistance, wear or other negative effects. Sleeves 36 also helps to prevent resistance bands 30 from binding against one another. Also, the use of sleeves 36 help to hold or guide resistance bands 30 in the proper place during exercise. The use of sleeves 36 also helps to prevent resistance bands 30 from being hung up on objects when exercising such as a user's swinging arms, or other persons or objects near the user while exercising.

In an alternative arrangement, instead of using a single sleeve for each resistance band, a single sleeve 36 is replaced by a plurality of loops 38 connected to the surface of garment 12. These loops 38 resemble belt loops as is known in the art which guide resistance bands 30 between attachment sites 22 and serve a similar function to sleeves 36. Alternatively, instead of using a sleeve 36 which is attached to the exterior surface of garment 12, an opening in garment 12 is positioned near or adjacent to each attachment site 22 and the resistance band 30 is passed between an exterior 14 layer of material of garment 12 and an interior 16 layer of material of garment 12. This arrangement provides a smooth exterior 14 surface of garment 12 which reduces the potential for catching a resistance band on an object.

In operation, the user selects the garment 12 and selects resistance bands 30 having a proper length and level of resistance for the application. Next the user attaches one end of each resistance band 30 to the first attachment site 22. In the event that the attachment sites 22 are loops or D-Rings and the coupling device is a hook 32B, resistance band 30 is connected to attachment site 22 by hooking hook 32B over the loop or D-Ring. Alternatively, in the event that the attachment sites are posts 22A connected to garment 12 by a base 22B and the coupling member 32 is an opening 30-1 in resistance band 30, resistance band 30 is connected to attachment site by sliding the opening 30-1 in resistance band 30 over the post 22A. Once in this position, head 22C retains resistance band 30 on post 22A. Once the first end of resistance band 30 is connected to the first attachment site 22, in the event that loops 38 or a sleeve 36 is present the user passes the elastic band 30 through the plurality of loops 38 or sleeve 36. Next, the user attaches the second end of resistance band 30 to the second attachment site 22 in the same manner described above with respect to the first attachment site 22. Once the band 30 is connected, the user adjusts the length of the resistance bands 30 by adjusting either the adjustment mechanism 34 or selecting the proper opening 30-1 to slide over post 22B. Once adjusted the resistance band 30 is fully installed on the garment 12. This process is repeated for each resistance band 30.

When wearing garment 12, the padded elements 20 on the interior 16 of the garment 12 engage the muscles the garment 12 surrounds to resist movement of these muscles. Meanwhile the resistance bands 30 on the exterior 14 of the garment 12 similarly cover these muscles via the garment 12 to further resist the movement of these muscles. In this arrangement, resistance bands 30 are positioned on top of or over padded elements 20, such that the padded elements 20 protect the user's mussels from irritation or excessive compression during exercises by dissipating the direct pressure from resistance bands 30 when they are stretched. That is, a padded element 20 extends underneath each attachment site 22 connected by a resistance band 30 with the padded element 20 extending the length of resistance band 30. This provides a more-comfortable garment 12 when exercising.

As the individual participates in an exercise whether running, karate, hurdling, walking, rehabbing, different types of other conditioning and the like, additional resistance is added to the muscles surrounded by the garment 12 to provide extra resistance and further workout to those muscle areas. While exercising an individual may remove a resistance band 30, tighten a resistance band 30 by adjustment mechanism 34, or replace a band 30 in order to vary resistance during an exercise. In addition, a secondary band 30 can be attached at one of the attachment sites 22, such as the middle-back 24E, middle front 241), or any other portion of the garment 12, and secured to a wall, parachute, weight or any other fixed or moveable object 40 to provide additional resistance and potential exercising techniques.

Thus, provided is an exercise system that is presented on a garment 12 worn by an individual. An individual need only to place the resistance bands 30 with the desired resistance in a location desired such that the system 10 is the only piece of exercise equipment the user needs to achieve a substantial and sufficient workout. This eliminates the need for multiple and costly exercise machines and devices.

The system 10 including the resistance bands 30 and padded elements 20 provide resistance in order to enhance a workout or exercise activity and to improve conditioning. Thus, all the stated problems have been overcome.

It will be appreciated by those skilled in the art that other various modifications could be made to the device without parting from the spirit and scope of this invention. All such modifications and changes fall within the scope of the claims and are intended to be covered thereby.

What is claimed is:

1. An exercise system comprising:

a pair of shorts;

the pair of shorts having a front, a back, a top, a bottom, a left side, a right side, an exterior surface and an interior surface;

top attachment sites are connected to the front and back of the shorts adjacent the top, on the left side and on the right side;

bottom attachment sites are connected to the front and back of the shorts adjacent the bottom, on the left side and on the right side;

middle attachment sites are connected to the front and back of the shorts between the top attachment sites and the bottom attachment sites, on the left side and on the right side;

at least one padded element is connected to the shorts;

first resistance bands connected to the top attachment sites on the right side of the front and back of the shorts and connected to the bottom attachment sites on the left side of the front and back of the shorts;

second resistance bands connected to the middle attachment sites on the right side of the front and back of the shorts and connected to the middle attachment sites on the left side of the front and the back of the shorts;

third resistance bands connected to the top attachment sites on the left side of the front and the back of the shorts and connected to the bottom attachment site on the right side of the front and the back of the shorts;

wherein when the user exercises while wearing the shorts, the first resistance bands stretch to provide resistance to the user.

2. The exercise system of claim 1 wherein at least one attachment site is a loop.

3. The exercise system of claim 1 wherein resistance bands of varying strength are interchangeably used to vary the resistance when the user exercises while wearing the shorts.

4. The exercise system of claim 1 wherein each of the first resistance bands extends through a respective sleeve.

5. The exercise system of claim 1 wherein at least one resistance band is color-coded to indicate the level of resistance of the at least one resistance band.

6. The exercise system of claim 1 wherein when the user exercises while wearing the shorts, the at least one padded element compresses and stretches to provide resistance to the user.

7. The exercise system of claim 1 wherein at least one attachment site is detachably secured to the shorts.

8. The exercise system of claim 1 wherein at least one attachment site is a post.

9. The exercise system of claim 1 wherein at least one attachment site is secured to a fixed object by a fourth resistance band.

10. The exercise system of claim 1 wherein at least one attachment site is secured to a moveable object by a fourth resistance band.

* * * * *